US012722824B2

(12) United States Patent
Baron et al.

(10) Patent No.: US 12,722,824 B2
(45) Date of Patent: Sep. 1, 2026

(54) POWDER INTAKE UNIT

(71) Applicant: Tetra Laval Holdings & Finance S.A., Pully (CH)

(72) Inventors: Antoine Baron, Cholet (FR); Frédéric Odet, La May sur Evre (FR); Christian Sieg, Saint-léger-sous-Cholet (FR); Cedric Bertali, Saint-léger-sous-Cholet (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 143 days.

(21) Appl. No.: 18/713,727

(22) PCT Filed: Nov. 28, 2022

(86) PCT No.: PCT/EP2022/083417

§ 371 (c)(1),
(2) Date: May 28, 2024

(87) PCT Pub. No.: WO2023/099379

PCT Pub. Date: Jun. 8, 2023

(65) Prior Publication Data

US 2025/0033815 A1 Jan. 30, 2025

(30) Foreign Application Priority Data

Nov. 30, 2021 (EP) ..... 21211437

(51) Int. Cl.
*B65B 37/02* (2006.01)
*B65B 69/00* (2006.01)

(52) U.S. Cl.
CPC ..... *B65B 37/02* (2013.01); *B65B 69/0008* (2013.01); *B65B 2210/06* (2013.01)

(58) Field of Classification Search
CPC . B65B 37/02; B65B 69/0008; B65B 2210/06; B65B 69/00; B05B 13/0627; B08B 9/093; B65D 2231/008
See application file for complete search history.

(56) References Cited

U.S. PATENT DOCUMENTS 2,293,160 A * 8/1942 Miller ..... C10H 21/00 137/376
3,602,400 A * 8/1971 Cooke ..... B65D 88/128 222/143

(Continued)

FOREIGN PATENT DOCUMENTS

CN 113291880 A * 8/2021 ..... B65G 69/14
CN 214397468 U 10/2021
EP 3196136 B1 12/2018

OTHER PUBLICATIONS

Extended European Search Report dated Aug. 25, 2022, for European Application No. 21211437.5.

(Continued)

*Primary Examiner* — Donnell A Long
(74) *Attorney, Agent, or Firm* — Lawrence S. Drasner

(57) ABSTRACT

A powder intake unit is configured to receive powder from an opened powder bag. The powder intake unit includes an upper section defining an inlet, and a lower conical section that tapers radially inwardly from a top end at which the lower conical section is connected to the upper section to a bottom end at which an outlet for discharging the powder is arranged. An upper section of the powder intake unit has a rear wall arranged opposite the inlet and a ceiling that is inclined downwardly from the inlet toward the rear wall.

14 Claims, 4 Drawing Sheets

(56) References Cited

U.S. PATENT DOCUMENTS

| | | | | | |
|---|---|---|---|---|---|
| 4,541,549 | A | * | 9/1985 | Hadley | A01C 7/06 222/608 |
| 5,226,775 | A | | 7/1993 | Bohle | |
| 5,992,699 | A | * | 11/1999 | Johnson | A01C 15/04 222/608 |
| 9,028,132 | B2 | | 5/2015 | Ungerechts et al. | |
| 9,700,864 | B2 | | 7/2017 | Evans | |

OTHER PUBLICATIONS

International Search Report mailed May 24, 2023, for International Application No. PCT/EP2022/083417.

* cited by examiner

POWDER INTAKE UNIT

TECHNICAL FIELD

The invention relates to a powder intake unit and to a method using the powder intake unit for emptying food powder from a bag.

BACKGROUND

Various food ingredients are held in bags, such as sugar, milk powder, salt, flour and other forms of food product in powdery or granular form. During food processing, the powder bags are often transported into a hygienic area in which they are opened by an operator and emptied in a powder intake unit, which may also be referred to as a bag tipping unit. The powder intake unit has an inlet to receive the powder from the bag and an outlet to discharge the powder for further downstream processing.

Powder intake units typically have a rectangular shape. Rectangular powder intake units may be deficient in handling powder due to the arrangement of the surfaces in the powder intake unit. For example, powder may adhere to interior surfaces such that some of the powder may not be discharged from the powder intake unit for downstream processing. Conventional powder intake units may also be difficult to clean due to the arrangement of the surfaces. The surfaces may be difficult to clean as the cleaning fluid that is sprayed into the powder intake unit is unable to reach all of the surface area of the surfaces.

SUMMARY

It is an object of the invention to at least partly overcome one or more limitations of the prior art. In particular, it is an object to provide a powder intake unit having surfaces that are designed to facilitate removal of powder from the surfaces during cleaning.

According to a first aspect of the invention, a powder intake unit is configured to receive powder from an opened powder bag. The powder intake unit includes an upper section defining an inlet, and a lower conical section that tapers radially inwardly from a top end at which the lower conical section is connected to the upper section to a bottom end at which an outlet for discharging the powder is arranged. An upper section of the powder intake unit has a rear wall arranged opposite the inlet and a ceiling that is inclined downwardly from the inlet toward the rear wall.

The powder intake unit described herein is advantageous in that all of the surfaces are inclined relative to a vertical axis of the powder intake unit, such that the powder moves downwardly along the surfaces toward the outlet during operation. The inclined surfaces also facilitate powder removal from the surfaces during cleaning. The cleaning spray is able to move downwardly along the surfaces to remove excess powder from the surfaces. The excess powder and cleaning spray are then drawn out of the powder intake unit.

According to a second aspect of the invention, a method for emptying food powder from a bag is provided. The method includes feeding the powder into the inlet; and discharging the powder from the outlet, such that food powder inside the powder intake unit moves downwardly toward the outlet.

Still other objectives, features, aspects and advantages of the invention will appear from the following detailed description as well as from the drawings.

BRIEF DESCRIPTION OF DRAWINGS

Embodiments of the invention will now be described, by way of example, with reference to the accompanying schematic drawings.

DETAILED DESCRIPTION

Embodiments of the invention will now be described more fully hereinafter with reference to the accompanying drawings, in which some, but not all, embodiments of the invention are shown. The invention may be embodied in many different forms and should not be construed as limited to the embodiments set forth herein.

Figure 1:
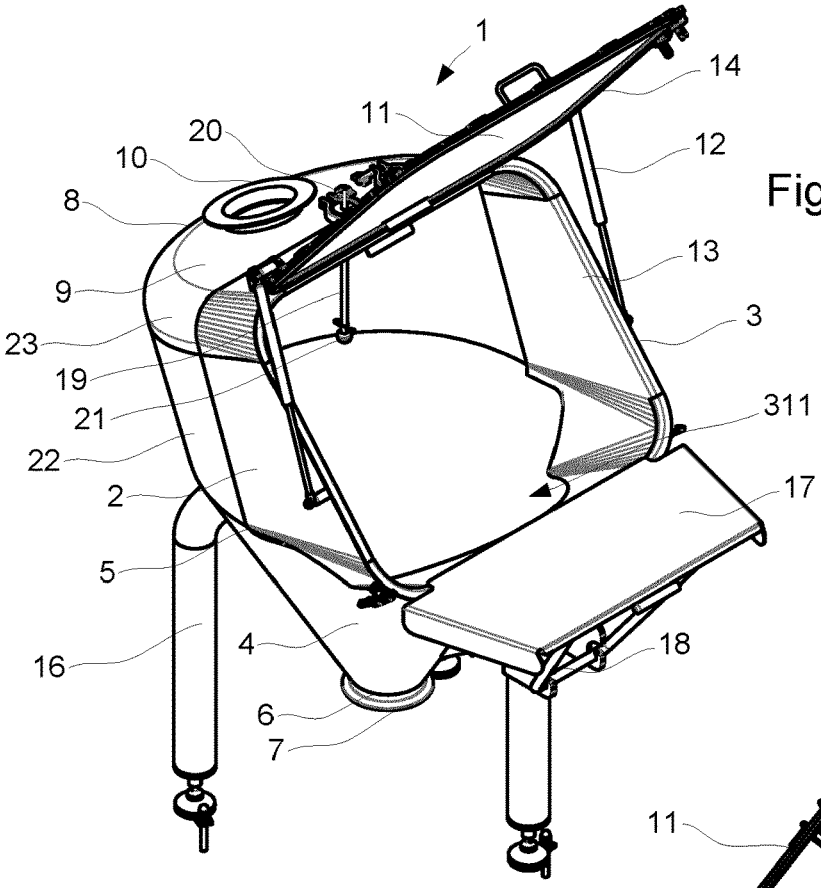
FIG. 1 is a perspective view of a powder intake unit configured to receive powder from an opened powder bag.
Figure 2:
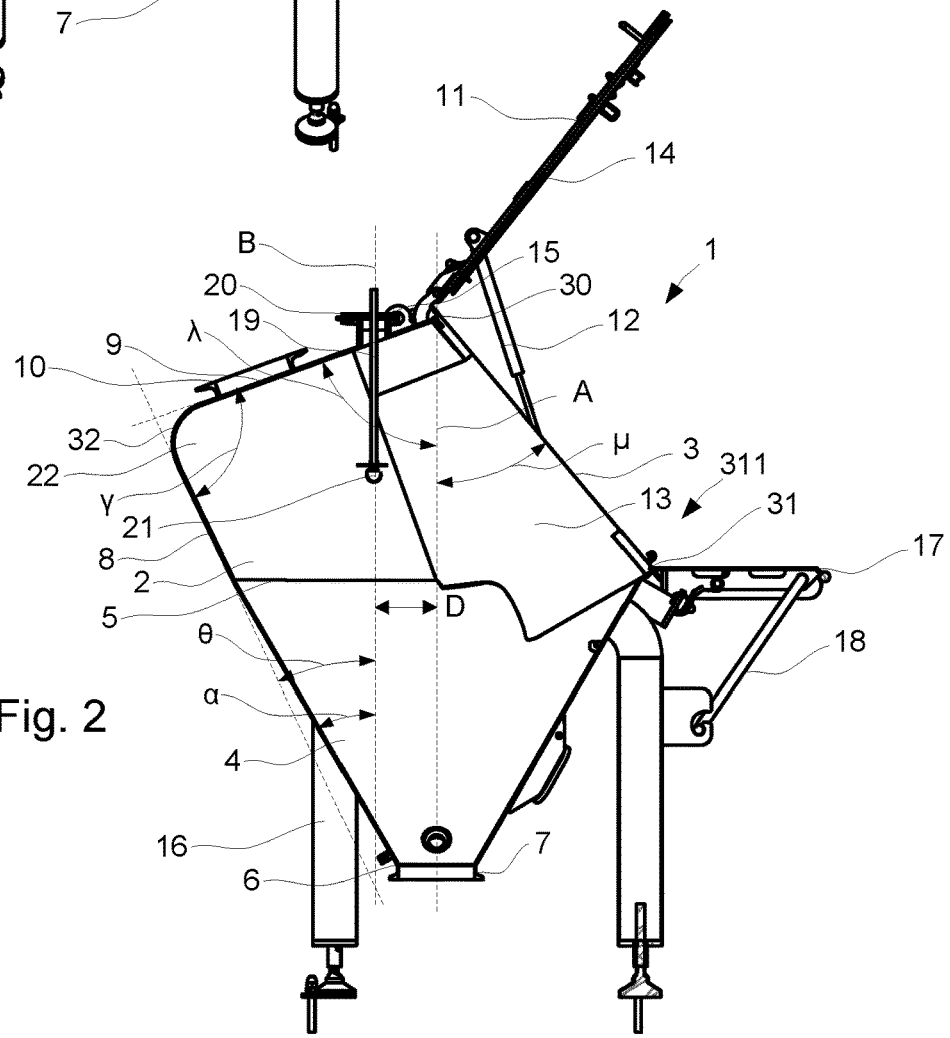
FIG. 2 is a side sectional view of the powder intake unit shown in FIG. 1.
Figure 3:
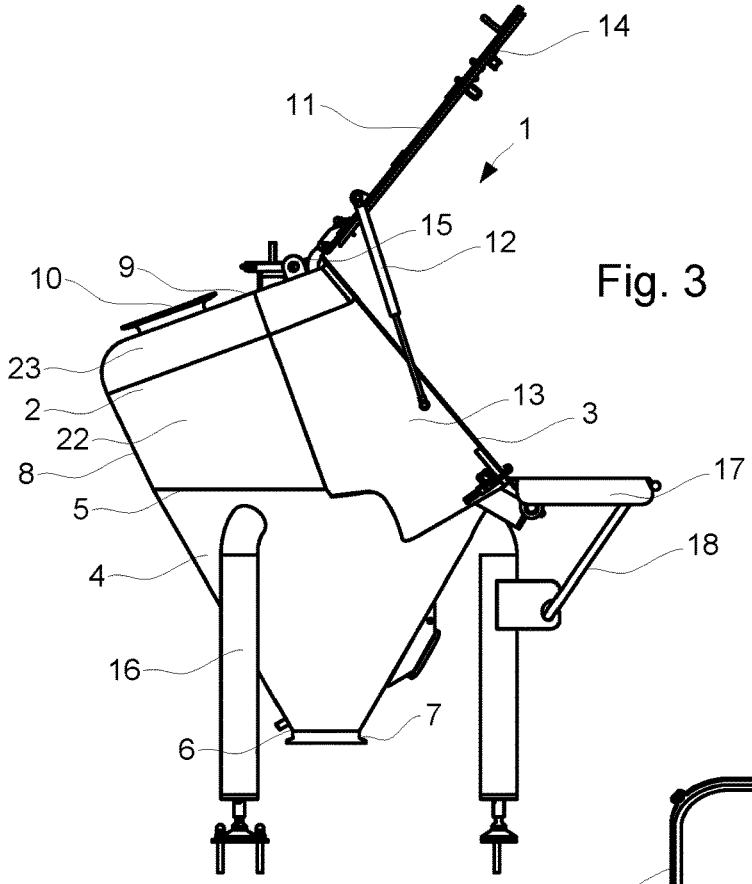
FIG. 3 is a side view of the powder intake unit shown in FIG. 1.

With reference to FIGS. 1-3, a powder intake unit 1 configured to receive powder from an opened powder bag is illustrated. The powder bag may contain a food ingredient such as sugar, milk powder, salt, flour or other forms of food product in powdery or granular form. The powder intake unit 1 is arranged in a hygienic area along a food processing line. The powder intake unit 1 may be configured to receive the powder bag from a conveyor or a machine operator, such that the powder bag is provided to the powder intake unit 1 using an automated process, manual operation, or a combination thereof. The powder is emptied from the powder bag into the powder intake unit 1 and subsequently discharged from the powder intake unit 1 for further downstream processing, such as mixing, to produce a food product.

The powder intake unit 1 is oriented vertically on a ground surface. The powder intake unit 1 includes an upper section 2 that defines an inlet 3 configured to receive the powder from the opened powder bag. The inlet 3 defines a front of the powder intake unit 1. The powder intake unit 1 includes a lower conical section 4 having a top end 5 at which the lower conical section 4 is connected to the upper section 2. The lower conical section 4 has a bottom end 6 that is opposite the top end 5 and has an outlet 7 for discharging the powder from the powder intake unit 1. The top end 5 and the bottom end 6 may be arranged in horizontal planes. The outlet 7 may be circular in shape and defines a vertical axis A which may be a central axis of the powder intake unit 1. The lower conical section 4 is tapered radially inwardly from the top end 5 to the bottom end 6 to define a funnel for the powder. The entire bottom of the powder intake unit 1 may be defined by the outlet 7.

The upper section 2 of the powder intake unit 1 has a rear wall 8 that is arranged opposite the inlet 3 that is at the front of the powder intake unit 1. A ceiling 9 of the upper section 2 is inclined downwardly from the inlet 3 toward the rear wall 8, such that a top end of the inlet 3 is higher than a top end of the rear wall 8. A vacuum outlet 10 is arranged on the ceiling 9 between the rear wall 8 and the inlet 3. The vacuum outlet 10 is configured for connection to a vacuum for drawing out the cleaning fluid and powder removed from the surfaces of the powder intake unit 1 during a cleaning operation of the powder intake unit 1. The vacuum outlet 10 may be inclined along with the ceiling 9 and is arranged at a location along the ceiling 9 that is proximate the rear wall 8.

The inlet 3 is opened and closed by a door 11 that is connected to the upper section 2 by arms 12. The door 11 is hinged to the ceiling 9 and connected to a rectangular portion 13 of the upper section 2 by the arms 12. The rectangular portion 13 defines the inlet 3 and forms a front of the powder intake unit 1 opposite the rear wall 8. The arms 12 may be telescoping arms that extend when the door 11 is opened away from the inlet 3 and retract when the door 11 is closed over the inlet 3. The door 11 is movable in an upward and downward direction. The door 11 has a seal 14 that is arranged along an entirety of the perimeter of the door 11. The seal 14 is configured to mate with the inlet 3 for sealing the door 11 and the powder intake unit 1 when the door 11 is closed during operation. The inlet 3 and the seal 14 have a complementary shape.

When the door 11 is opened, the door 11 is raised above the powder intake unit 1 such that the inlet 3 is unhindered by the door 11 to enable a maximum open area for receiving the powder inside the powder intake unit 1. The door 11 may be held in the open position by the extended arms 12 and a hinge having a mechanical locking mechanism 15 connected between the door 11 and the ceiling 9. The inlet 3 and the door 11 may have any suitable shapes. The inlet 3 and the door 11 may be rectangular in shape, such that the seal 14 is also rectangular in shape. The rectangular portion 13 defines part of the ceiling 9 that is inclined downwardly from the inlet 3 toward the rear wall 8. The rectangular portion 13 defines the inlet 3 that is inclined downwardly from the ceiling 9 toward the front of the powder intake unit 1.

The powder intake unit 1 is supported above the ground by legs 16. The legs 16 may be attached to the lower conical section 4 and any number of legs 16 may be provided. The powder intake unit 1 may be supported such that the outlet 7 is raised slightly above the ground on which the legs 16 sit. The powder intake unit 1 may be supported such that the inlet 3 is positioned at a height that is manually accessible by an operator of the powder intake unit 1.

A table 17 for the opened powder bag is arranged at the front of the powder intake unit 1 proximate the inlet 3. The table 17 is horizontal and removably connectable to the front of the powder intake unit 1. The table 17 may include any suitable releasable mechanical connection to the legs 16 arranged at the front of the powder intake unit 1 and the inlet 3. The connection may include linkages 18 that directly connect the table 17 to the powder intake unit 1 such that the table 17 is supported above the ground by the connection to the powder intake unit 1.

As shown in FIGS. 1 and 2, a nozzle 19 is mounted to the ceiling 9 and extends downwardly inside the upper section 2. The nozzle 19 is configured to spray a cleaning fluid into the powder intake unit 1 for cleaning the inside surfaces of the powder intake unit 1. A clamp 20 is provided to clamp the nozzle 19 to the ceiling 9. The nozzle 19 includes a spray ball 21 arranged at an axial end of a pipe of the nozzle 19 inside the powder intake unit 1. The spray ball 21 may be arranged at a central location of the upper section 2 to ensure that cleaning spray reaches a maximum area of the surfaces during the cleaning operation. The pipe of the nozzle 19 has a vertical axis B that is offset from the vertical axis A of the outlet 7. The vertical axis B of the nozzle 19 is arranged between the rear wall 8 and the vertical axis A with the vertical axis B being closer to the vertical axis A than the rear wall 8. The vertical axis B is offset from the vertical axis A by a distance D that is between 5 and 15 centimeters. The distance between the vertical axes A, B may be approximately 10 centimeters.

The nozzle 19 extends downwardly through a cylindrical portion 22 of the upper section 2 that is connected to the rectangular portion 13. The cylindrical portion 22 defines the rear wall 8. The bottom of the cylindrical portion 22 is connected to the top end 5 of the lower conical section 4. The top end 5 of the lower conical section 4 lies in a horizontal plane, such that the bottom of the cylindrical portion 22 and the top end 5 of the lower conical section 4 meet along the horizontal plane. A top portion 23 of the upper section 2 is disc-shaped and extends over the cylindrical portion 22 and the rectangular portion 13 to define the ceiling 9. The rectangular portion 13, the cylindrical portion 22, and the top portion 23 may be formed integrally as one piece or as separate pieces that are subsequently attached together.

As shown in FIG. 2, ends of the inlet 3 and the ceiling 9 meet at a point 30 that is arranged along the vertical axis A defined by the outlet 7, such that the ceiling 9 is arranged on one side of the vertical axis A and the inlet 3 is arranged on the opposite side of the vertical axis A. The rear wall 8 is arranged on the same side of the vertical axis A as the ceiling 9. The surface of the lower conical section 4 extends around the vertical axis A. The point 30 may form a topmost point of the powder intake unit 1. The nozzle 19 is arranged between the rear wall 8 and the topmost point 30.

The inlet 3 may extend downwardly in a direction toward the front 311 of the powder intake unit 1. The inlet 3 may extend downwardly in a direction toward a frontmost end 31, of the powder intake unit 1. The front 311 of the powder intake unit 1 may be defined as the side of the powder intake unit 1 where the inlet 3 is arranged. Downwardly may be defined as the direction that is downwards in relation to the vertical direction.

The inlet 3 may be angled downward toward the front 311 of the powder intake unit 1 relative to the vertical axis A by an angle μ that is smaller than 90 degrees, by an angle μ that is smaller than 80 degrees, or by an angle μ that is even smaller. The inlet 3 may be angled toward the front 311 of the powder intake unit 1 relative to the vertical axis A by an angle μ that is between 20 and 60 degrees, or by an angle μ that is between 30 and 60 degrees. The angle μ may be approximately 45 degrees. The inlet 3 extends downwardly from the topmost point 30 away from the ceiling 9 to the frontmost end 31 of the powder intake unit 1. The frontmost end 31 also defines a bottom of the inlet 3. The lower conical section 4 meets the inlet 3 at the frontmost end 31. The table 17 may be removably connected to the powder intake unit 1 proximate the frontmost end 31 such that the table 17 extends horizontally outwardly from the frontmost end 31.

In contrast to conventional powder intake units that have straight surfaces, such as horizontal ceilings and vertical walls, all of the surfaces of the powder intake unit 1 are inclined relative to the vertical axes A, B. All of the surfaces being inclined enables the powder to move downwardly along the surfaces toward the outlet 7 during operation by way of gravity. During cleaning, the inclined surfaces enable the cleaning spray to move downwardly along the surfaces and remove excess powder from the surfaces. The removed powder and cleaning spray is then drawn out of the powder intake unit 1 by a vacuum.

Each of the inlet 3, the ceiling 9, and the surface of the lower conical section 4 is inclined by at least 20 degrees relative to the vertical axes A, B. The ceiling 9 is angled downwardly from the topmost point 30 toward the rear wall 8 relative to the vertical axis A by an angle λ. The angle λ is less than 90 degrees and greater than the angle μ between the vertical axis A and the inlet 3. The angle λ may be approximately 60 degrees. The ceiling 9 meets the rear wall 8 of the cylindrical portion 22 along a curved portion 32 of the upper section 2. The curved portion 32 is defined by the top portion 23 of the upper section 2 and may form a rearmost portion of the powder intake unit 1. The ceiling 9 and the rear wall 8 may be angled relative to each other by an angle λ that is less than 90 degrees.

The rear wall 8 is angled relative to the vertical axes A, B of the powder intake unit 1 by an angle θ that is greater than an angle α by which a surface of the lower conical section 4 is angled relative to the vertical axes A, B. Each of the angles θ, a may be between 30 and 60 degrees. A length of the rear wall 8 extending from the ceiling 9 to the top end 5 of the lower conical section 4 is less than a length of the surface of the lower conical section 4 from the bottom end 6 to the top end 5. The length of the rear wall 8 may be less than the length of the inlet 3 from the topmost point 30 to the frontmost end 31 and the length of the ceiling 9 from the topmost point 30 to the curved portion 32.

Figure 4:
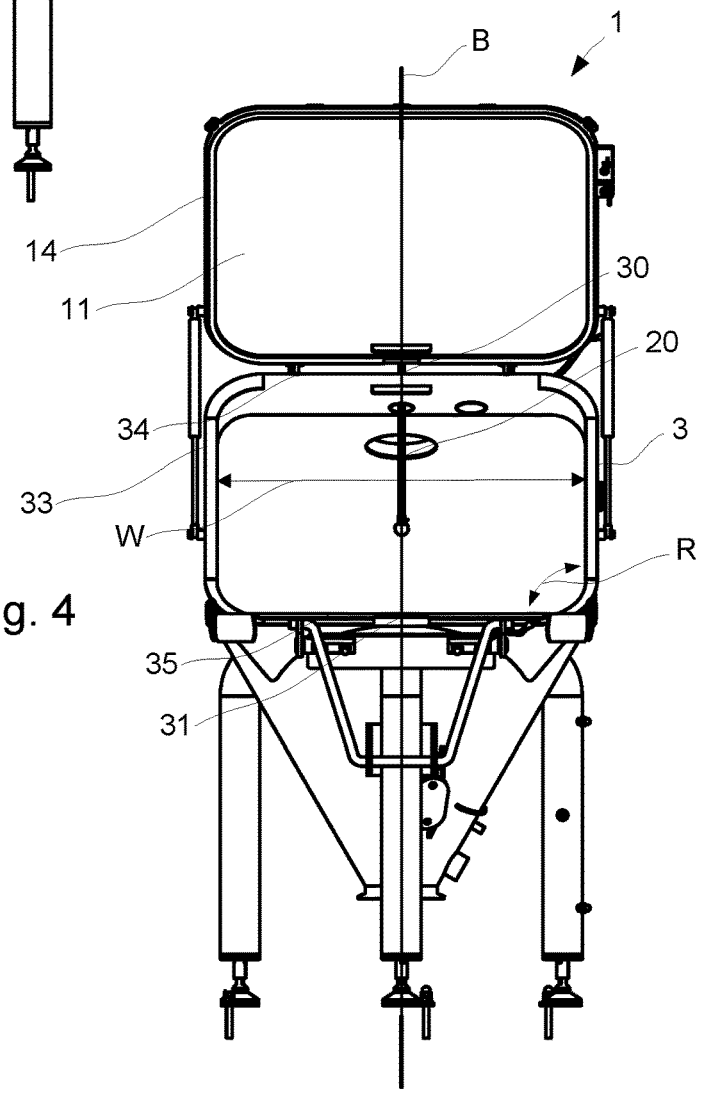
FIG. 4 is a front view of the powder intake unit shown in FIG. 1.

Referring now to FIG. 4, a front view of the powder intake unit 1 is shown. The inlet 3 is defined by parallel inclined sides 33 and parallel horizontal sides 34, 35. The parallel horizontal sides 34, 35 define a bottom and top of the inlet 3. The topmost point 30 of the powder intake unit 1 is arranged along the top horizontal side 34 and the frontmost end 31 is arranged along the bottom horizontal side 35. The parallel inclined sides 33 extend from the bottom horizontal side 35 to the top horizontal side 34 and are inclined relative to the vertical axis B of the nozzle 20. The parallel horizontal sides 34, 35 extend between the parallel inclined sides 33 to define a width W of the inlet 3. The length of the parallel horizontal sides 34, 35 may be longer than the length of the parallel inclined sides 33.

Each of the corners at which one of the inclined sides 33 meets one of the parallel horizontal sides 34, 35 defines a radius of curvature R that is less than the width W of the inlet 3. The radius of curvature R may be between 5 and 15% of the width W. Each radius of curvature R may be the same along the inlet 3. The seal 14 and the door 11 has a shape that is complementary to the shape of the inlet 3, such that the door 11 includes similar radii of curvature to the inlet 3. Providing the inlet 3 with radii of curvature enables a maximum opening area for the powder intake unit 1 to facilitate emptying of the powder bag.

Figure 5:
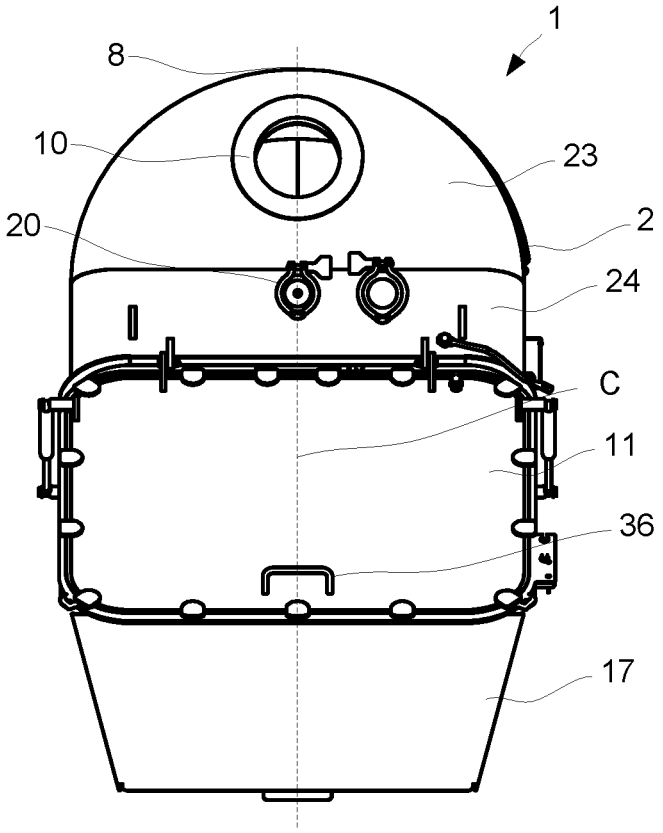
FIG. 5 is a top view of the powder intake unit shown in FIG. 1.

Referring now to FIG. 5, a top view of the powder intake unit 1 is shown. The vacuum outlet 10 is formed in a central location of the top portion 23 of the upper section 2. The top portion 23 is continuously formed with the rear wall 8 and the rectangular portion 24. The clamp 20 for the nozzle is arranged between the rectangular portion 24 and the top portion 23. The clamp 20 may be arranged along a horizontal central axis C of the powder intake unit 1 that is defined from a front end to a back end of the powder intake unit 1. The door 11 includes a handle 36 formed on an outside surface of the door 11. As shown in FIG. 5, the top portion 23 of the upper section 2, the rectangular section 24, the door 11, and the table 17 may have a symmetrical shape about the central axis C. In contrast, the upper section 2 does not have a symmetrical shape about the vertical axis A, as shown in FIG. 2.

Figure 6:
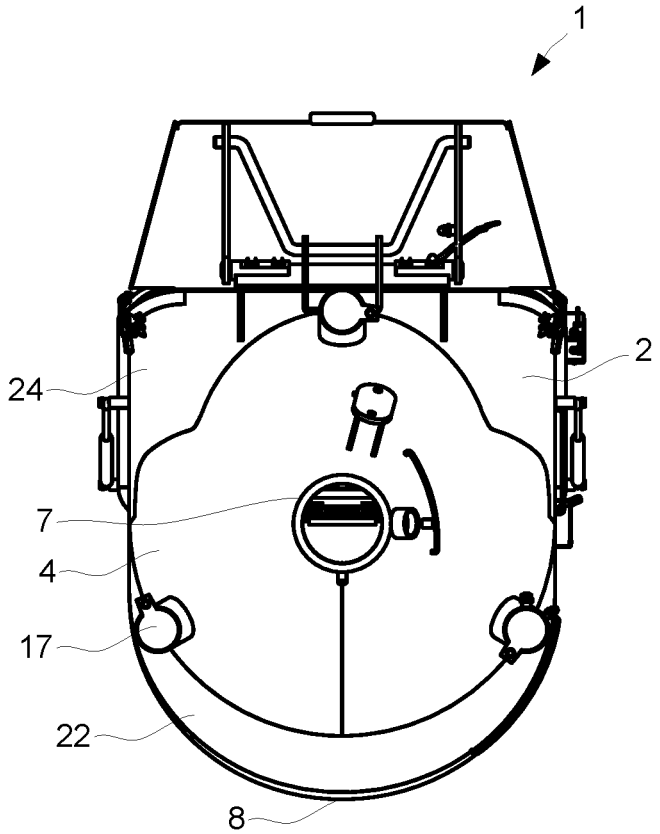
FIG. 6 is a bottom view of the powder intake unit shown in FIG. 1.

Referring now to FIG. 6, a bottom view of the powder intake unit 1 is shown. The cylindrical portion 22 of the upper section 2 that defines the rear wall 8 extends past the lower conical section 4 in a horizontal direction to define the rearmost end of the powder intake unit 1. The rectangular portion 24 of the upper section 2 also extends past the lower conical section 4 in a horizontal direction. The powder intake unit 1 includes three legs 17 that are disposed symmetrically about the outlet 7 which defines a center of the powder intake unit 1.

Figure 7:
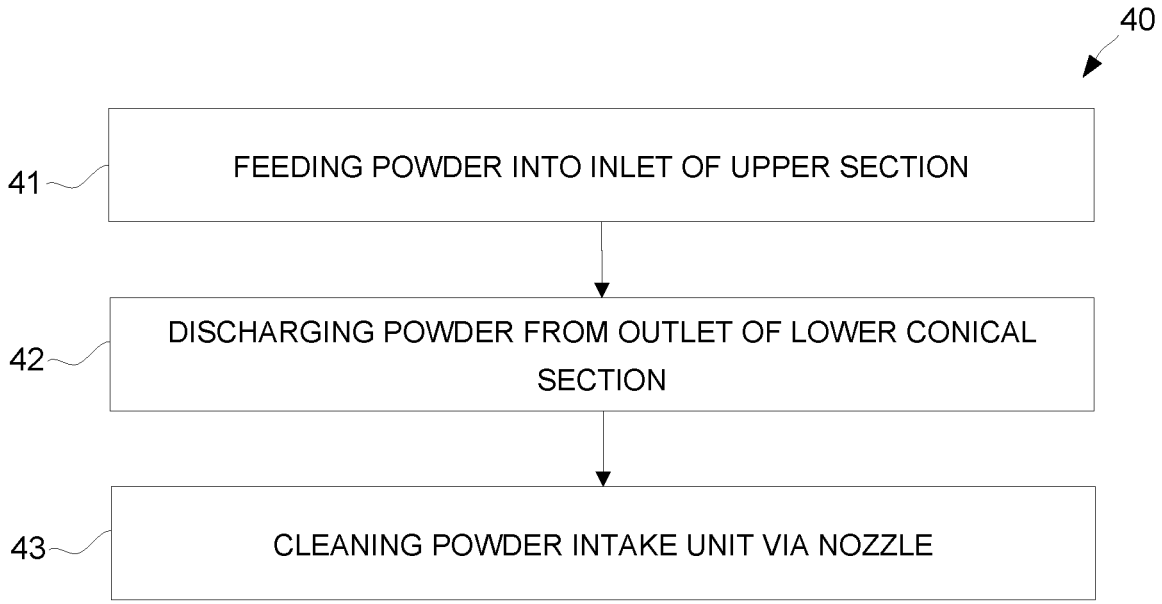
FIG. 7 is a flow chart of a method for emptying food powder from an opened bag containing food powder using a powder intake unit such as the powder intake unit shown in FIG. 1.

Referring now to FIG. 7, a method 40 for emptying food powder from an opened bag containing food powder using the powder intake unit shown in FIGS. 1-6 is shown. Step 41 of the method 40 includes feeding the powder into the inlet 3. Step 42 of the method 40 includes discharging the powder from the outlet 7. During operation, the inclination of the ceiling 9 enables the food powder to move downwardly along the ceiling 9 toward the rear wall 8 and downwardly along the rear wall 8 toward the outlet 7. Step 43 of the method 40 includes cleaning the powder intake unit 1 via the nozzle 19 mounted to the ceiling 9.

While the invention has been described with reference to one or more preferred features, which features have been set forth in considerable detail for the purposes of making a complete disclosure of the invention, such features are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

The invention claimed is:

1. A powder intake unit configured to receive powder from an opened powder bag, the powder intake unit comprising:

an upper section defining an inlet for receiving the powder; and a lower conical section that tapers radially inwardly from a top end at which the lower conical section is connected to the upper section to a bottom end at which an outlet for discharging the powder is arranged, wherein:

the upper section has a rear wall arranged opposite the inlet and a ceiling that is inclined downwardly from the inlet toward the rear wall, and the rear wall is inclined inwardly from the ceiling toward the lower conical section.

2. The powder intake unit according to claim 1, comprising a nozzle mounted to the ceiling and extending downwardly inside the upper section for cleaning the powder intake unit.

3. The powder intake unit according to claim 2, wherein a vertical axis of the outlet is offset from a vertical axis of the nozzle.

4. The powder intake unit according to claim 3, wherein the vertical axis of the nozzle is arranged between the rear wall and the vertical axis of the outlet.

5. The powder intake unit according to claim 1, wherein the inlet and the ceiling meet at a point arranged along a vertical axis of the outlet.

6. The powder intake unit according to claim 1, comprising a vacuum outlet arranged on the ceiling.

7. The powder intake unit according to claim 1, comprising a door for closing the inlet, the door connected to the ceiling and having a seal configured to mate with the inlet.

8. The powder intake unit according to claim 1, wherein the inlet is defined by parallel inclined sides that extend between a horizontal top side and a horizontal bottom side of the inlet, such that the inlet has four corners, wherein each corner has a radius between 5 and 15 percent of a width of the inlet, the width being defined by a distance between the parallel inclined sides.

9. The powder intake unit according to claim 1, wherein each of the inlet, the ceiling, and a surface of the lower conical section is inclined by at least 20 degrees relative to a vertical axis of the powder intake unit.

10. The powder intake unit according to claim 1, wherein the rear wall is angled relative to a vertical axis of the powder intake unit by an angle that is greater than an angle by which a surface of the lower conical section is angled relative to the vertical axis.

11. The powder intake unit according to claim 1, wherein the upper section has a cylindrical portion that defines the rear wall.

12. The powder intake unit according to claim 1, comprising a table removably connected to a frontmost end of the powder intake unit at which the inlet meets the top end of the lower conical section.

13. A method for emptying food powder from a bag, the method using a powder intake unit according to claim 1 and comprising:

feeding the powder into the inlet; and discharging the powder from the outlet, such that food powder inside the powder intake unit moves downwardly toward the outlet.

14. The method according to claim 13, comprising cleaning the powder intake unit by feeding cleaning liquid through the nozzle.

* * * * *